United States Patent [19]

Miller et al.

[11] Patent Number: 4,876,421

[45] Date of Patent: Oct. 24, 1989

[54] ASBESTOS-FREE ARC-CONFINING INSULATING STRUCTURE

[75] Inventors: Richard Miller, Devon, Pa.; John E. Zlupko, Marlton, N.J.

[73] Assignee: General Electric Company, King of Prussia, Pa.

[21] Appl. No.: 221,093

[22] Filed: Jul. 19, 1988

[51] Int. Cl.[4] ..... H01H 33/08

[52] U.S. Cl. ..... 200/144 C; 200/149 R; 200/149 A

[58] Field of Search ..... 200/144 C, 149 R, 149 A, 200/149 B

[56] References Cited

U.S. PATENT DOCUMENTS 4,006,330 2/1977 Korte et al. ..... 200/144 C

*Primary Examiner*—Robert S. Macon

*Attorney, Agent, or Firm*—Henry J. Policinski; William Freedman

[57] ABSTRACT

Arc-confining structure for an electric circuit interrupter has an arc-exposed portion constructed of an electrical insulating material that is the thermosetting reaction product of the constituents of a mixture consisting essentially of the following constituents in the following percentages by weight of the mixture:

(a) 25 to 55 percent granular high-forsterite olivine, (b) 20 to 50 percent of a second granual constituent consisting essentially of silica sand, and (c) 15 to 28 percent phosphoric acid.

The mixture is essentially free of asbestos.

12 Claims, 2 Drawing Sheets

ASBESTOS-FREE ARC-CONFINING INSULATING STRUCTURE

BACKGROUND

This invention relates to structure for confining an electric arc and, more particularly, relates to arc-extinguishing structure such as an arc chute for an electric circuit breaker.

Most electric circuit breakers contain a pair of normally-closed separable arcing contacts through which current flows just prior to opening of the circuit breaker. When circuit interruption is to be effected, these contacts are separated, and an electric arc is initiated between them. Circuit interruption is normally accomplished by extinguishing this arc within a short time after its initiation. One way of accomplishing this is to utilize an arc chute for elongated and/or dividing the arc and for cooling the hot arcing products, thereby deionizing the gap between the contacts so as to prevent the arc from reigniting after a natural current zero, assuming an a.c. circuit.

In one type of arc chute we are concerned with, there are a pair of spaced-apart side walls of electric insulating material for laterally confining the arc and the arcing products and a plurality of spaced-apart metal plates extending transversely of the arc and having edges against which the arc is driven to effect division of the arc and further cooling of the arcing products. These sidewalls have typically been made of an insulating material that is the heat and pressure reacted thermoset product of several constituents, one of which is chrysotile asbestos, used in relatively large percentages of the total weight of the material.

The use of chrysotile asbestos in such insulating material is advantageous in that it imparts to the material good impact strength, good tensile strength, and fair-to-good arc-erosion resistance. But a significant disadvantage of using chrysotile asbestos as a component of the material is the possible health problem associated with the handling of chrysotile asbestos during manufacture of the material.

OBJECTS

Accordingly, an object of our invention is to provide arc-confining electrical-insulating structure (e.g., the side-walls of an arc chute) that is made without using asbestos and yet has sufficient impact strength, tensile strength and arc-erosion resistance to enable it to be effectively used where materials with a relatively high asbestos content have previously been relied upon.

SUMMARY

In carrying out our invention in one form, we provide arc-confining structure that has an arc-exposed portion constructed of an electrical insulating material that is the thermosetting reaction product of the constituents of a mixture consisting essentially of the following constituents in the following percentages by weight of the mixture:

(a) 25 to 55 percent granular high-forsterite olivine,
(b) 20 to 50 percent of a second granular constituent consisting essentially of silica sand, and
(c) 15 to 28 percent phosphoric acid.

This mixture, after its constituents are mixed, is molded under heat and pressure to form a partially-cured molded piece, which piece in part serves as said portion of the ac-confining structure. This piece, after this molding, is baked to substantially complete curing thereof, following which a surface zone of the piece is flame-treated at a sufficiently high temperature to convert the material of said zone to a surface glaze.

The above mixture is essentially free of asbestos.

BRIEF DESCRIPTION OF DRAWINGS

For a better understanding of the invention, reference may be had to the following description taken in connection with the accompanying drawings, wherein.

DETAILED DESCRIPTION OF PREFERRED EMBODIMENTS

Figure 1:
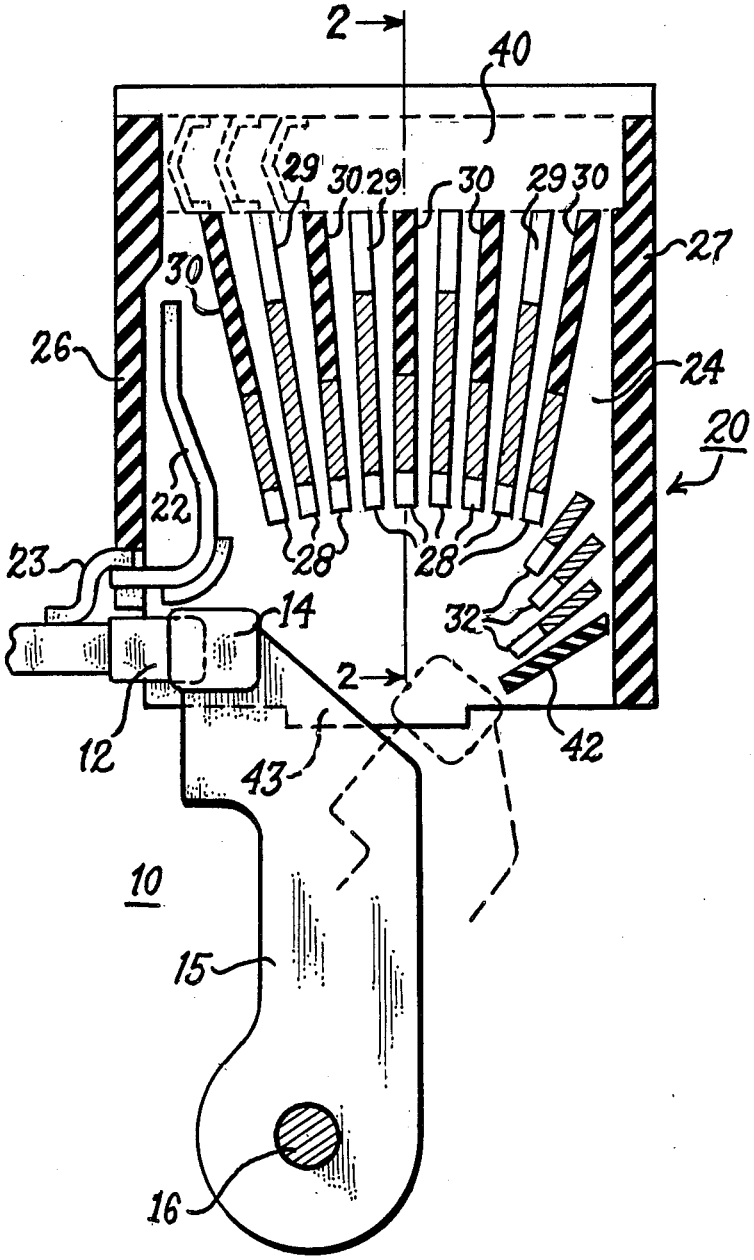
FIG. 1 is a sectional view of a circuit interrupter comprising an arc chute embodying one form of our invention.

Referring now to FIG. 1, the circuit interrupter 10 illustrated therein comprises a pair of normally-closed contacts 12 and 14 through which current flows when the interrupter is closed. Contact 12 is a stationary contact, and contact 14 is a movable contact that is joined to the upper end of a pivotally-mounted conductive arm 15 that has its lower end mounted on a fixed point 16. Circuit interruption is initiated by driving the arm 15 in a clockwise direction about pivot 16 from its solid line position into its dotted line position of FIG. 1, thereby separating the movable contact 14 from the stationary contact 12.

For simplicity, the interrupter 10 has been illustrated in a form in which there are only contacts (12 and 14). In a commercial form of the interrupter, there will also be, electrically in parallel with the illustrated arcing contacts, one or more pairs of separable current-carrying contacts (not shown) that carry most of the current when the interrupter is closed. During opening, these current-carrying contacts separate first and then the arcing contacts separate. When the current-carrying contacts separate, the current previously flowing therethrough is transferred to the still-closed arcing contacts. When the arcing contacts separate shortly thereafter, most of the current is then flowing therethrough. Since this contact arrangement is conventional and well-known, its details have been omitted in order to simplify the drawing.

When the contacts 12 and 14 are separated, an arc is drawn between them, and this arc is magnetically driven upwardly into an arc chute 20. During such arc movement, the left-hand terminal of the arc moves upwardly along a metal arc runner 22 that is electrically connected at its lower end (by conductor 23) to the stationary contact 12, while the right-hand arc terminal remains on the moving contact 14. One effect of this arc movement is to elongate the arc.

The arc chute 20 comprises two spaced-apart sidewalls 24 that are disposed on opposite lateral sides of the above-described arc and that act to laterally confine the arc and the hot gases and vapors generated by the arc. These sidewalls are maintained in the desired spaced relation by vertically-extending end walls 26 and 27 located at opposite ends of the arc chute and suitably clamped between the sidewalls. These end walls are of electrical insulating material and substantially close off these ends of the arc chute, substantially preventing arcing products from exiting the chute through these ends.

Extending between the sidewalls 24 transversely of the arc are a plurality of spaced-apart metal plates 28, preferably of a magnetic stainless steel. These metal plates are supported on the sidewalls by grooves 29 formed in the sidewalls and receiving the lateral edges of the metal plates. As seen in FIG. 1, alternate ones of the metal plates 28 are short compared to the other metal plates 28. Aligned with the shorter metal plates 28 are insulating splitter plates 30 that are also supported on the sidewalls 24 by the same grooves that receive the metal plates 28. Additional metal plates 32, also extending transversely of the arc, but in a more horizontal direction, are disposed in spaced-apart relation at the extreme right-hand end of the arc chute. Plates 32 are supported on the sidewalls 24 by grooves formed in the sidewalls and receiving the lateral edges of plates 32.

Figure 2:
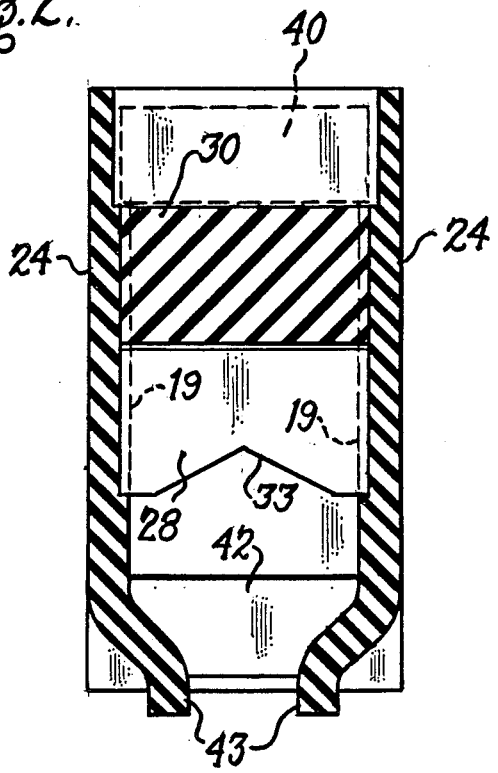
FIG. 2 is a sectional view along the line 2—2 of FIG. 1. Certain background parts are omitted from FIG. 2 for simplicity.

As shown in FIG. 2, the plates 28 have V-notches 33 in their lower ends. These V-notches act in a well-known manner to cause magnetic forces to be developed on an arc entering the V-notch, which forces act in a direction to force the arc toward the apex of the V-notch.

When the above-described arc is driven upwardly into the arc chute, it encounters the lower edges of the metal plates 28 and is thus divided into a series of shorter arcs, or arclets, that extend between adjacent metal plates. These arclets continue moving upwardly, but are prevented from recombining into a single arc across the upper edges of the metal plates 28 by the insulating splitter plates 30 that are present in this region. The metal plates 28 and the sidewalls 24 act to cool the hot vapors and gases generated by the arc and the arclets and thus to deionize the spaces between the contacts 12 and 14 and between adjacent metal plates 28. Accordingly, at an early current zero in the alternating current being interrupted, the arc is prevented from reigniting between the contacts and also between the metal plates. More specifically, when the usual recovery voltage transient builds up immediately following such current zero, there is sufficient dielectric strength in these spaces and along the bridging surfaces of the insulating sidewalls 24 to prevent arc reignition.

As above noted, the insulating sidewalls 24 act to confine the arcing products and prevent them from traveling laterally of the arc chute. Almost all of these arcing products are forced upwardly and exit the arc chute through its open top end, but only after being cooled by the metal plates 28, the splitter plates 30, the sidewalls 24, and a muffler 40 of conventional design that extends across the top of the arc chute. This muffler comprises perforated metal sheets 41 (only some of which are illustrated) located in horizontally-spaced relationship in the region extending horizontally across the top of the chute. An arc chute with a similar muffler and similar V-notched metal plates is disclosed in U.S. Pat. No. 3,440,378—Baird, assigned to the assignee of the present invention.

To assist in directing the arcing products upwardly through the arc chute, a transversely-extending barrier plate 42 of insulating material is provided at the lower end of the chute and the lower regions of sidewalls 24 are provided with inwardly projecting portions 43 that form a restricted throat around the movable contact arm 15. These parts 42 and 43, in effect, block off the lower end of the arc chute against the exit of arcing products.

The upwardly-looping shape of the current path through the arc chute when the arc is present provides upwardly acting magnetic force that further contributes to driving conductive arcing products upwardly.

As will be apparent from the above description, the sidewalls 24 are very important parts of the arc chute. They must have good impact strength and tensile strength to withstand the mechanical forces and shocks that are present during interruption and at other times, and they must have the ability to withstand the high temperature produced by exposure to the arc and arcing products without significantly eroding and without significant loss of dielectric strength and other electrical and mechanical properties after many circuit interruptions.

The materials that have typically been used heretofore for the sidewalls have been thermosetting reaction products of asbestos and other components, caused to react under heat and pressure. The asbestos has imparted good mechanical strength and fair-to-good arc erosion resistance to the final material, but, as pointed out hereinabove under "BACKGROUND," asbestos has certain disadvantages that make it highly desirable to avoid its use in this application.

We have developed a material that has mechanical properties and arc-erosion resistance properties that enable the illustrated arc chute, when built with such sidewalls, to be used in place of, and to be assigned the same current-interrupting ratings as, previous arc chutes of substantially the same size with asbestos-based sidewalls.

In one form of the invention, this material is the reaction product of the following constituents present in a starting mixture of these constituents in the following percentage ranges by weight:

(a) 25 to 55% granular olivine of a type that has a high forsterite content,
(b) 0 to 20% ceramic fiber,
(c) 20 to 50% silica sand, apart from any silica present in the other constituents, and
(d) 15 to 28% phosphoric acid.

The olivine that was used in one embodiment had the following composition in approximate percentages by weight:

forsterite ($2MgO \cdot SiO_2$) 90%
fayalite ($2FeO \cdot SiO_2$) 10%

This olivine is a naturally-occurring mineral available from Reade Metals and Mineral Corp., Rumson, New Jersey. In Examples 1 and 2 hereinafter, the olivine used in the starting mixture is a granular material having a nominal particle size of 200 mesh, U.S. Standards/ASTM E-11-81, and is referred to by Reade as its No. 200 olivine, domestic grade. In example 3, we use a combination of this 200 mesh olivine and 120 mesh granular olivine of the same composition.

The silica sand used in all the Examples was 99.98% $SiO_2$ by weight and had a particle size of 325 mesh, U.S. Standards/ASTM E-11-81.

The phosphoric acid ($H_3PO_4$) that was used in all the Examples was present in an aqueous solution having a concentration of 75% phosphoric acid.

Generally speaking, increased tensile strength can be obtained in the final material if ceramic fibers are added to the starting mixture at an appropriate point in the mixing stage. By adding ceramic fibers of the type hereinafter specified and in the amounts specified, we are able to effect increased tensile strength of the final material without impairing the other desired properties of the final material. The ceramic fiber used in Examples 1 and 2 hereinafter was a high temperature aluminum zirconium silicate ceramic fiber available from its manufacturer, Kaopolite, Inc. of Union, New Jersey, under the designation FiberKal-ZR-50. Typical physical properties are: density of 26.05 pounds per solid gallon, bulking value of 0.0384 gallon per pound, average fiber length of 0.50 inches, maximum fiber length of 1.0 inch, and stable to 2000° F.

A typical chemical composition of the ceramic fiber by weight percentage ranges is as follows:

aluminum oxide ($Al_2O_3$) 33–35%
silicon dioxide ($SiO_2$) 48–50%
zirconium dioxide ($ZrO_2$) 15–18%
miscellaneous oxides (e.g., oxides of Fe, Ti, Mg, Ca, etc.) 2% maximum The following are specific examples of processes for preparing out material.

EXAMPLE 1

In preparing one batch of this material, the following quantities were used:

olivine 20 pounds (34.8%)
silica sand 14 pounds (24.3%)
ceramic fiber 9 pounds (15.7%)
75% phosphoric acid 14.5 pounds (25.2%)

The olivine and the sand were mixed for 10 minutes, after which the ceramic fiber was added and mixing was continued for three more minutes. The phoric acid was then slowly added, and mixing was continued for 4 more minutes.

The mixing was carried out in a container having a water cooled jacket supplied with cooling water at a temperature of 40–45° F. to avoid overheating.

Next, a quantity of the mixed batch was placed in a preheated mold comprising upper and lower dies defining a mold cavity between them of approximately the form of one of the sidewalls 24. A suitable mold release compound was applied to the active surfaces of the dies after preheating and before filling of the mold cavity. The preheat temperature for the lower die surface was between 180° F. and 190° F. and for the upper die surface between 190° F. and 200° F. The dies have surrounding jackets into which steam or hot water can be supplied to control the surface temperature.

In the above loading of the mold cavity, 1 pound, 3 ounces of the mix was placed therein. A press was used to then force the dies together and supply about 5000 psi to the mold contents, which, in this case, was a 36 square inch piece. This pressure was held for 10 minutes while steam at 250° F. to 275° F. was applied to the surrounding mold jacket to effect a partial cure of the molded piece. Then, the mold was opened and the molded piece slowly ejected. The molded piece was then still near mold temperature, and it was placed on a flat surface where it was cooled to room temperature.

Twenty-four hours or more after the molded piece was thus released, it was suitably machined to its final dimensions. Care should be taken during machining to avoid any conditions that would result in subjecting the piece to tensile loads.

Next, but after one day of additional curing in air at normal room temperature, the molded piece was baked in an over at about 600° F. for about 6 hours. Care should be taken to limit the rate of rise of temperature of the piece to about 100° F. per hour. After such baking,- the oven was cooled to less than 100° F. before removal of the piece.

Within 24 hours after baking, the molded piece was subjected to another heat-treating procedure. In this procedure, a portion of the surface of the molded piece that faces the inside of the arc chute is subjected to an arc-plasma flame treatment operation wherein hot arc-plasma from an arc-plasma flame torch impinges against this surface portion and converts the material of this surface portion to an amorphous fused material, or glaze, the major portion of which appears to be silica. The surface portion that is subjected to this flame-treatment is that which will be located in the throat of the arc chute 20, i.e., the region including and adjacent the projecting portions 43. In a typical arc-plasma flame-treatment operation, an arc plasma torch with a ⅜ inch diameter nozzle spaced 1 ½ inches from the piece is moved relative to the work piece in straight line parallel paths at a speed of 450 inches per minute across the surface of the piece. The torch is indexed ⅜ inch on each pass, and only one pass is made over a given area.

This general type of arc plasma torch and flame treating operation, applied to a different material, are described in U.S. Pat. No. 3,814,620—Bailey et al, assigned to the assignee of the present invention. Also of interest in this regard is U.S. Pat. No. 4,006,330—Korte and Zlupko, also assigned to the assignee of the present invention.

A properly flame-treated surface of our material has a glossy appearance and a light brown color with some areas a dark brown color.

After molded pieces were prepared as above described, two of the pieces were used for building an arc chute of the type shown in FIG. 1, serving in the arc chute as the sidewalls 24. Current interrupting tests on this arc chute have demonstrated that a circuit interrupter including this arc chute can interrupt 60 KA at 250 V and 45 KA at 500 V, which is the interrupting rating of an interrupter having an arc chute of the same size having sidewalls and an end wall made with asbestos. Accordingly, the new arc chute, which significantly, is made with no asbestos, can be used in existing designs of circuit breakers in place of the prior arc chute without the need for otherwise substantially modifying the circuit breaker. It is especially noteworthy that there is no need to modify the circuit breaker to accommodate any larger size interrupter or arc chute.

EXAMPLE 2

In preparing another batch of this material, the following quantities of constituents were used:

olivine 20 pounds (38.1%)
silica sand 14 pounds (26.7%)
ceramic fiber 7 pounds (13.3%)
phosphoric acid 11.5 pounds (21.9%)

The constituents were substantially identical in composition to those used in Example 1. They were mixed in the same manner as described in Example 1, following which a quantity of the mixed batch was loaded into a preheated mold. This mold was a different mold from that used in Example 1, having a much larger mold area, i.e., 180 square inches as compared to 36 square inches.

This larger mold also included two separable dies defining the mold cavity and a press for forcing the dies together to compress the mold contents with the desired pressure. The dies were likewise provided with jackets having passages for receiving steam or cooling water to control their temperature.

Before the mold was loaded, the die surfaces were preheated to 250°–275° F. by steam supplied to the surrounding jackets. Then 10 ½ pounds of the mixed batch were loaded into the mold cavity, and the press for the mold was operated to apply about 5500 psi to the mold contents. The mold was maintained under high pressure with steam in its jackets for 15 minutes to effect a partial cure of the mold contents, and the cooling water was supplied to the jackets for 15 minutes. Then the mold was opened and the molded piece ejected.

After suitable cooling, the molded piece was subjected to suitable machining, following which the machined part or parts were baked, allowed to cool, and then arc-plasma flame treated in the same manner as described in Example 1.

The machining operation converted the relatively large molded piece into a plurality of smaller ones for use as the sidewalls 24 of the arc chute of FIGS. 1 and 2. Current interrupting including this arc chute have demonstrated that an interrupter including this arc chute can interrupt 60KA at 250 V amd 45KA at 500 V, thus enabling it to be used in place of an arc chute of the same size having sidewalls and an end wall made with asbestos.

EXAMPLE 3

In preparing another batch of material, the following constituents were used in a starting mixture:

olivine 18 pounds (52.1%)
silica sand 10 pounds (29%)
phosphoric acid 6.5 pounds (18.8%)

No ceramic fiber was present in this mixture. The constituent olivine was a mixture of 7 pounds granular olivine, 120 mesh, and 11 pounds granular olivine, 200 mesh. These two olivine components were mixed for about 5 minutes, following which the silica sand was added and mixing continued for about 10 minutes. Then the phosphoric acid was slowly added and mixing was continued for 5 to 10 more minutes.

Then a quantity of the mixed batch was placed in the dies of the mold of Example 1, where the preheat temperature was about 195° F. The dies were then forced together with a force that subjected the mold contents to a pressure of 9,000 psi. This pressure was held for 18 minutes while hot water at a temperature of about 195° was applied to the surrounding mold jacket to effect a partial cure of the molded piece. Then the mold was opened, and the molded piece was ejected while hot.

After about 24 hours following release, the piece was machined as described in Example 1. This machining in Examples 1 and 3 is a relatively minor operation, since most of the configurational features of the piece were introduced by molding in these particular Examples. Then followed a relatively long curing period of 5 days in air at normal room temperature. This was followed by baking for about 6 hours at a temperature of about 250° F, which is considerably below that used in Example 1. After this baking operation, the piece was allowed to cool and then subjected to the same arc-plasma flame treatment as described in connection with Example 1.

After molded pieces were prepared as above described, two of the pieces were used for building an arc chute of the type shown in FIG. 1, serving in the arc chute as the sidewalls 24. Current interrupting tests on this arc chute have demonstrated that a circuit interrupter including this arc chute can interrupt 60 KA at 250 V and 45 KA at 500 V, which is the interrupting rating of an interrupter having an arc chute of the same size having sidewalls and an end wall made with asbestos.

GENERAL DISCUSSION

In the above examples, it will be apparent that the constituents are free of asbestos. This significant because it is a basic object of our invention to achieve such freedom from asbestos.

It is noted that in Example #3, no ceramic fibers were present in the relied-upon mixture to lend increased tensile and impact strength. This, however, has been compensated for by using substantially increased molding pressures, which factor contributes to increased mechanical strength in the final material. In certain applications, it is feasible to design the molded piece for increased thickness in critical regions to offset impact strength restrictions.

Glass fiber does not seem to be a satisfactory substitute for the ceramic fiber where relatively high mechanical strength is required., since the other constituents of the mix do not sufficiently we the glass fiber during mixing.

While the silica sand constituent plays an important role in all three examples, it is to be noted that a portion of this constituent can be replaced by other refractory-forming granular materials with similar properties, e.g., zircon sand ($ZrO_2$).

In the above examples, the molding operation is used to convert the plastic mix into a solid piece of the desired shape. The molding operation partially cures the solid material, but the curing action is carried much further and substantially to completion during the subsequent baking operation.

The molding operation is also used to effect a knitting together of the material being molded. The amount of phosphoric acid is selected so that knitting occurs throughout the molded material, including its center, during the time allowed for molding. If the quantity of phosphoric acid is appreciably reduced from the specified percentages, too much time will be required for the molding operation to produce the desired knitting together.

The baking operation is used for effecting a substantially complete cure of the molded material and also for driving off water and other volatiles within the material.

The flame-treating operation is used for vaporizing and otherwise driving off from the surface region of the molded piece constituents which would tend to form conductive vapors if later driven off by the arc present in the circuit breaker. The flame-treating also converts this surface region into an amorphous fused material, or glaze, the major portion of which appears to be silica. A fused silica surface is known to have very good circuit interrupting properties.

Although we much prefer to use an arc plasma torch for this heat-treating step, for certain less demanding applications an acetylene torch may be used for this purpose.

Although Examples 1 and 2 hereinabove employed ceramic fiber having the typical chemical composition specified in the table just preceding the Example 1 heading, it is to be understood that other aluminum zirconium silicate compositions can instead be used for this fiber. For example, a ceramic fiber having approximately the following composition by weight appears to be satisfactory: 40% $ZrO_2$, 10% $Al_2O_3$, and 50% $SiO_2$.

While the arc chute shown in the drawings is a relatively simple type of arc chute, it is to e understood that our invention is also applicable to other arc chutes of different design, e.g., to an arc chute that is provided with a blow-out coil having a magnetic circuit including appropriately-designed pole pieces at the outer sides of the sidewalls (24) of the arc chute. In such an arc chute, the blow-out coil is normally out of the power circuit but is inserted in series with it by arc motion immediately following arc-initiation. In such a design, the blow-out coil and pole pieces develop a relatively intense magnetic field transversely of the arc that assists in driving the arc upwardly into the chute.

While we have shown and described particular embodiments of our invention, it will be obvious to those skilled in the art that various changes and modifications may be made without departing from our invention in its broader aspects; and we, therefore, intend in the appended claims to cover all such changes and modifications as fall within the true spirit and scope of our invention.

We claim:

1. Arc-confining structure for an electric circuit interrupter comprising a portion with a surface that is exposed to an electric arc, said portion being constructed of an electric insulating material that is the thermosetting reaction product of the constituents of a mixture consisting essentially of the following constituents in the following percentages by weight of the mixture:

(a) 25 to 55 percent granular high-forsterite olivine, (b) 20 to 50 percent of a second granular constituent consisting essentially of silica sand, and (c) 15 to 28 percent phosphoric acid;

which mixture, after mixing of its constituents, is molded under heat and pressure to form a partially-cured molded piece, which piece at least in part serves as said portion of the circuit interrupter; said piece, after molding, being baked to substantially complete curing thereof; and said piece having a surface region that provides the arc-exposed surface of said circuit interrupter portion, said surface region having a zone that is flame treated at a sufficiently high temperature to convert the material of said zone to a surface glaze.

2. The arc-confining structure of claim 1 in which said olivine contains at least about 90 percent by weight of forsterite.

3. The arc-confining structure of claim 1 in which said mixture is essentially free of asbestos.

4. The arc-confining structure of claim 3 in which said mixture includes ceramic fiber as an additional constituent, the ceramic fiber being present in the mixture in an amount of 20 weight percent or less.

5. The arc-confining structure of claim 1 in which said second granular constituent in said mixture includes zircon.

6. The arc-confining structure of claim 1 in which said mixture includes ceramic fiber as an additional constituent, the ceramic fiber being present in the mixture in an amount of 20 weight percent or less.

7. The arc-confining structure of claim 6 in which said ceramic fiber is aluminum zirconium silicate ceramic fiber.

8. An electric circuit interrupter comprising a pair of sidewalls spaced apart to define a space within which an electric arc is developed, each of said sidewalls including the arc-confining structure of claim 1 and including a portion exposed to said arc that corresponds to said portion defined in claim 1.

9. A circuit interrupter as defined in claim 8 and further comprising a plurality of spaced-apart metal plates extending transversely of said arc between said sidewalls and having edges against which said arc is driven to effect division of the arc.

10. A circuit interrupter as defined in claim 8 in which said arc is initiated in one region of the interrupter and arcing products are driven through an exhaust opening in another region of said interrupter, the interrupter having a throat region adjacent said arc-initiation region where the space between said sidewalls is relatively narrow compared to the sidewall spacing in other interrupter locations, the flame-treated zones of said sidewall portions being located at said throat.

11. The arc-confining structure of claim 1 in which said olivine is present in said mixture in a weight percentage of 45–55 percent.

12. The arc-confining structure of claim 1 in which said olivine is present in said mixture in a weight percentage of of 45–55 percent and the mixture is molded at a pressure of about 9,000 psi or higher.

* * * * *